United States Patent [19]

George

[11] Patent Number: 4,971,279

[45] Date of Patent: Nov. 20, 1990

[54] HANGER CLIP

[76] Inventor: Warren T. George, 3 Carrie Lynn, Billings, Mont. 59102

[21] Appl. No.: 374,999

[22] Filed: Jul. 3, 1989

[51] Int. Cl.[5] ..... A47G 1/00

[52] U.S. Cl. ..... 248/214; 248/340

[58] Field of Search ..... 248/214, 215, 301, 309, 248/339, 340, 489, 228, 298, 303, 307, 690, 692, 243, 343; 52/39; 24/230.5 R, 237, 546, 563

[56] References Cited

U.S. PATENT DOCUMENTS

| | | | |
|---|---|---|---|
| D. 275,527 | 9/1984 | Gee | 248/339 |
| 804,491 | 11/1905 | Millen | 248/495 |
| 950,361 | 2/1910 | Woods | 248/214 |
| 2,425,629 | 8/1947 | Mayer | 248/301 |
| 3,371,900 | 3/1968 | Jacobs | 248/215 |
| 3,952,985 | 4/1976 | Davenport | 248/317 |
| 4,012,023 | 3/1977 | Melanson | 248/489 |
| 4,073,458 | 2/1978 | Sease | 248/340 |
| 4,101,108 | 7/1978 | Klein | 248/301 |
| 4,203,175 | 5/1980 | Heine | 248/215 |
| 4,318,525 | 3/1982 | Welch | 248/228 |
| 4,337,915 | 7/1982 | Cali | 248/489 |

FOREIGN PATENT DOCUMENTS 1113913 12/1981 Canada .

*Primary Examiner*—Ramon O. Ramirez
*Assistant Examiner*—Robert A. Olson
*Attorney, Agent, or Firm*—John J. Byrne

[57] ABSTRACT

A hanger clip of a type for use with conventional suspended ceiling beams that have L-shaped beams along the wall of a room to which the ceiling is applied and vertical T-shaped beams extending transversely of the room, which hanger clip can be used with both beans but is formed with a return section which permits the hanger to suspend items from the L-shaped section so that they will be against the walls of the room but which can additionally be used with the vertical T-shaped beams for midroom suspensions.

6 Claims, 1 Drawing Sheet

FIG. 1
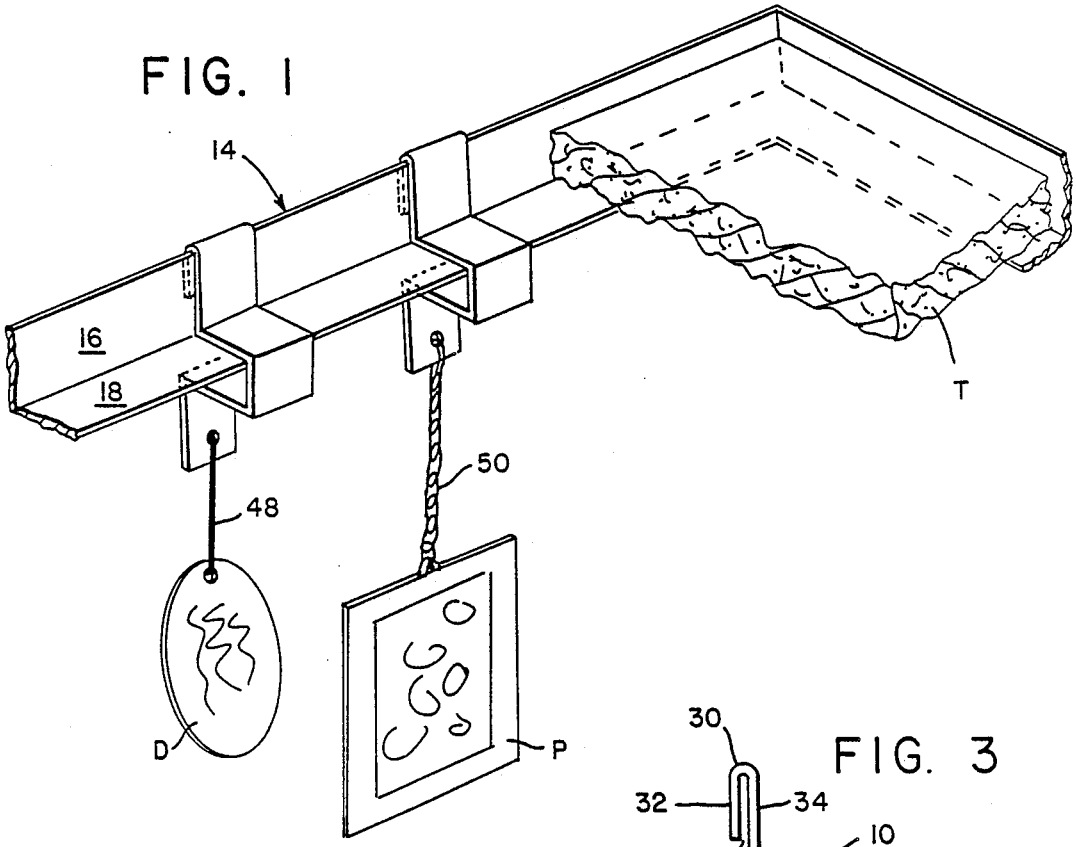
FIG. 3
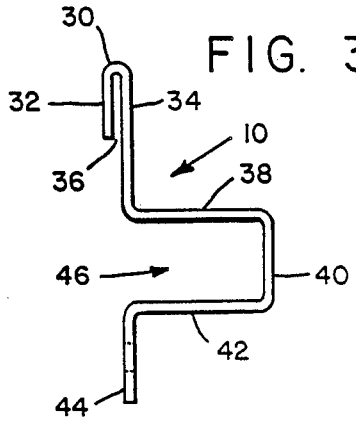
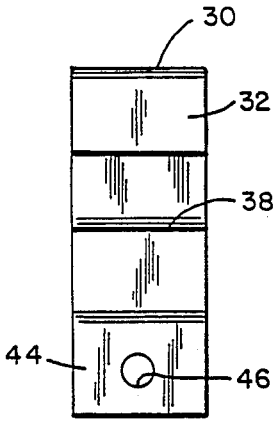
FIG. 2
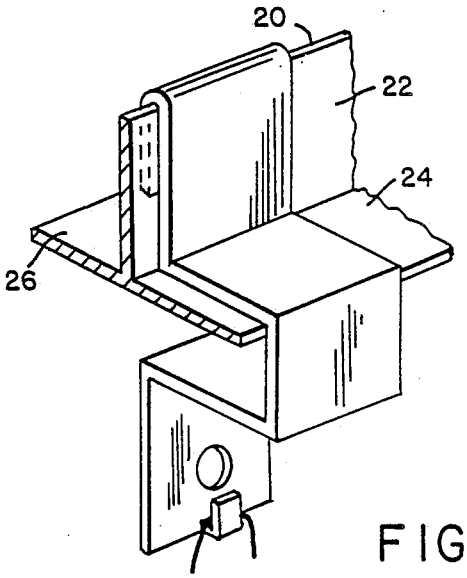
FIG. 4

HANGER CLIP

BACKGROUND OF THE INVENTION

The hanger clip of this invention is of the type from which articles can be suspended from inverted T-shaped and L-shaped beams commonly used with conventional suspended ceiling hardware. Ceiling clips of the prior art have been lacking in that they are unsuitable for use with the conventional L-shaped beams that circumscribe the room and with the traverse inverted T-shaped beams that run therebetween.

Many prior art hanger clips are known to the art. U.S. Pat. No. 4,318,525 to Welch, U.S. Pat. No. 4,073,458 to Sease, and U.S. Pat. No. 3,952,985 to Davenport are illustrative of hangers that use the horizontal flange of an inverted T-shaped beam as the principal support. Other U.S. patents such as Miller, U.S. Pat. No. 804,491, and U.S. Pat. No. D. 275,527 to Gee show inverted hooks that are used with the vertical portion of the beam. This is also shown by Canadian Pat. No. 1,113,913 issued to LeMay. U.S. Pat. No. 4,012,023 is prior art which shows a clip for use with the horizontal portion of an L-shaped beam.

SUMMARY OF THE INVENTION

In many commercial and residential environments where suspended ceilings are utilized, it is desirable to be able to suspend displays and advertisements from the ceiling and it is especially desirable to be able to suspend them close to the wall of the room. A principal objective of this invention is to provide a hanger clip for such hangings which can be utilized with equal efficiency with the L-shaped wall perimeter beams as well as with the traverse inverted T-beams.

Another important objective of the invention is to provide a hanger clip that will permit display items to be suspended from suspended ceiling beams whereby the display item can be located and remain adjacent the wall of the room since it is suspended from a beam that is generally co-planar with the wall.

Another objective of the invention is to provide a hanger clip construction which can snugly engage the vertical member of an L-shaped or inverted T-shaped beam and having a second section having two spaced-apart walls for accommodating the horizontal flange portion of the beam.

Another objective of the invention is to provide a clip which can easily slide along its supporting beam so that displays can be located where desired.

A still further objective and purpose of this invention is to provide a clip which can be manufactured of either metal or plastic and which is extremely simple, low cost, and economical in its manufacture.

It is a still further objective of the invention to provide an improved hanger clip which is easily installed by unskilled persons without the use of any tools.

These and other objects of the invention will become more apparent to those skilled in the art by reference to the following detailed description when viewed in light of the accompanying drawings.

BRIEF DESCRIPTION OF THE DRAWINGS

FIG. 1 is a perspective view of the invention showing the hanger of this invention in use;

FIG. 2 is a front elevational view of the hanger;

FIG. 3 is a side elevational view of FIG. 2; and

FIG. 4 is a perspective of another embodiment of the invention showing its use on an intermediate supporting member.

DETAILED DESCRIPTION OF THE PREFERRED EMBODIMENT

Referring now to the drawings wherein like numerals indicate like parts, the numeral 10 refers to the hanger clip of this invention. The hanger clip is adapted for use with a conventional L-shaped beam 14 of the type shown in FIG. 1. The L-shaped member includes a vertical member 16 and a horizontal flange 18. In most suspended ceiling hardware, an L-shaped beam of this type circumscribes the perimeter of the room. The flange 18 supports the tiles T in the conventional manner. The hanger of this invention can also be used with the conventional inverted T-shaped beams such as that indicated by the numeral 20 in FIG. 4. Beams of this type have first and second horizontal flanges 24 and 26 extending outwardly of the vertical flange 28. One of the advantages of the instant invention is that the hanger 10 can be used with either the L-shaped beam 14 or the inverted T-shaped beam 20 with equal effectiveness and, when used with the L-shaped beam, can suspend a display P adjacent the wall of the room.

FIG. 3, is a side view of the clip. At its upper end, the hanger is formed with an inverted U-shaped clip 30 having a first side 32 and a second side 34 that engage the vertical member of the beam. The side 34 extends downwardly a distance approximating the vertical height of the vertical member at which point it extends outwardly at 38, downwardly at 40, and is formed with a return member 42 leading to a section 44 which is co-planar with the side 34. A U-shaped member 46 is defined by elements 38, 40, and 42. The U-shaped member 46 receives the horizontal flange 18 or 24. As seen in FIG. 1, section 44 can be formed with a hole 48 to receive suspension cords 48 and 50 or, as seen in FIG. 4, it can be formed with a hook 52 to receive a suspension cord 54 for suspending pictures in a conventional manner. Section 44 can be provided both with the hook 54 as well as an opening 46.

As seen from the above description, the hangers can be installed on the beam by merely lifting one of the tiles T and placing the hook 30 thereover as shown. Since section 44 defines a space substantially thicker than the flanges 18 or 24, there is no difficulty with installation. Also, other clips, whether formed of plastic or metal, have a degree of resiliency that also facilitates installation.

It can be seen from the drawings that the clips can be easily slid along the length of either the L-shaped beam 14 or the inverted T-shaped beam 20 with ease. Therefore, the displays D can be located as desired along the length of the wall or suspended from the ceiling where desired. Of course, the other workers in the art have provided hangers that can suspend displays from different beams. This invention, however, permits a unit that provides means for an L-shaped beam and a T-shaped beam with equal facility and when used with the L-shaped beam the display remains close to the wall.

In a general manner, while there has been disclosed a preferred embodiment of the invention, it should be understood that the invention is not limited to such an embodiment as there may be changes made in the arrangement, disposition and location of the parts without departing from the principle of the present invention as comprehended within the scope of the accompanying claims.

I claim:

1. A hanger clip for use with a ceiling panel support member of the type having an elongated vertical member that extends across a room and having a horizontal flange extending therefrom upon which a ceiling panel is adapted to rest, the hanger comprising:

an inverted, U-shaped hook formed of first and second side members adapted to receive said vertical member;

said first side having a length less than the height of said vertical member;

said second side extending beyond the height of said vertical member to a lower end;

a second U-shaped member connecting said second side and said lower end and having third and fourth horizontal sides for receiving said horizontal flange therebetween; and means at said lower end to suspend a display therefrom.

2. The invention of claim 1 wherein said third side forms a horizontal ledge to receive a tile and extends beyond said horizontal flange.

3. The invention of claim 1 wherein said means is an aperture adapted to receive a supporting member.

4. The invention of claim 1 wherein said means is a hook.

5. The invention of claim 1 wherein said hanger clip is plastic.

6. The invention of claim 1 wherein said hanger clip is metallic.

* * * * *